US006817270B1

(12) United States Patent
Tremblay et al.

(10) Patent No.: US 6,817,270 B1
(45) Date of Patent: Nov. 16, 2004

(54) APPARATUS AND METHOD FOR ASSISTING MECHANICS WITH THE REMOVAL AND REPLACEMENT OF BRAKE DRUMS

(76) Inventors: David P. Tremblay, 131 Andover Rd., Billerica, MA (US) 01821; Karen A. Tremblay, 131 Andover Rd., Billerica, MA (US) 01821

( * ) Notice: Subject to any disclaimer, the term of this patent is extended or adjusted under 35 U.S.C. 154(b) by 0 days.

(21) Appl. No.: 09/702,957

(22) Filed: Oct. 31, 2000

(51) Int. Cl.[7] ..... B25B 9/00
(52) U.S. Cl. ..... 81/13; 81/125.1
(58) Field of Search ..... 87/13, 121.1, 124.3, 87/177.1, 125.1, 177.85

(56) References Cited

U.S. PATENT DOCUMENTS 1,512,559 A * 10/1924 Moore ..... 81/177.1
1,547,093 A * 7/1925 Burch ..... 81/177.1
1,618,046 A * 2/1927 Barb ..... 81/125.1
1,641,252 A * 9/1927 Dickey ..... 81/13
1,796,083 A * 3/1931 Carlberg ..... 81/125.1
1,810,006 A * 6/1931 Edwards ..... 81/121.1
2,148,573 A * 2/1939 Mulcay ..... 81/177.1
2,895,364 A * 7/1959 Heinz ..... 81/177.1
5,052,251 A 10/1991 Mills
5,123,312 A 6/1992 Brawand
5,477,758 A * 12/1995 Cunningham ..... 81/177.85
6,085,618 A * 7/2000 Macor ..... 81/177.85
6,089,128 A * 7/2000 Kopyless ..... 81/124.7
6,427,564 B1 * 8/2002 Nelson ..... 81/177.2

FOREIGN PATENT DOCUMENTS

JP 06315783 A * 11/1994 ..... 81/13

* cited by examiner

*Primary Examiner*—James G. Smith
(74) *Attorney, Agent, or Firm*—Richard J. Musgrave

(57) ABSTRACT

A drumbar apparatus and method that allows one mechanic positioned at the frontside of a wheel on a trailer, truck, bus or any other vehicle that utilize Dayton Wheels™ or spoke wheels to hold a bolt head of a bolt located on the backside of the wheel to prevent said bolt from rotating while simultaneously removing or replacing a nut located on the frontside of the wheel that comprises a wrench end located at a second end portion of the drumbar apparatus used to hold a socket and wherein the socket is used to hold the bolt on the backside of the wheel, a handle located at first end portion of said wrench end, a middle section connecting the handle and the wrench end wherein the mechanic positioned at the frontside of the wheel holds the handle of the drumbar with his/her first hand and extends the drumbar apparatus through the axle housing of the wheel and holds the bolt located on the backside of the wheel with the socket and wherein the mechanic rotates the nut located on the frontside of the wheel on or off the bolt with a tool held in his second hand.

1 Claim, 4 Drawing Sheets

APPARATUS AND METHOD FOR ASSISTING MECHANICS WITH THE REMOVAL AND REPLACEMENT OF BRAKE DRUMS

BACKGROUND OF THE INVENTION

The present invention relates generally to a nut wrench called a drumbar and, more particularly, to a nut wrench used for removing and replacing nuts and bolts to remove and replace the brake drums in the wheels of trailers, trucks, buses and all other vehicles that utilize spoke wheels, including but not limited to Dayton Wheels™ manufactured by the Dayton Wheel Products Company. Dayton Wheel Products Company is located at 115 Compark Road Dayton, Ohio 45459

The process of removing and replacing brake drums requires the mechanic to remove nuts and bolts from the wheel to remove and replace the brake drums. The mechanic holds the bolt located on the backside of the wheel to prevent the bolt from rotating while rotating the nut located on the frontside of the wheel on or off the bolt. One way to accomplish this task is to have the mechanic use extensions and bars to reach the bolts on the backside of the wheel while rotating the nuts on the frontside. This process requires the mechanic to straddle the wheel with his arms and to control two tools at one time, which can be very cumbersome and awkward, and requires a high degree of skill.

Alternatively, two mechanics can assist each other in the process of removing and replacing the brake drums. One mechanic positions himself/herself behind the wheel assembly of the vehicle to hold the bolts located on the backside of the wheel to prevent the bolts from rotating while the second mechanic removes or replaces the nuts on the bolts from the frontside of the wheel. This process requires two mechanics which is labor intensive and costly.

In a third method for removing and replacing the nuts and bolts that secure the brake drums to the wheel one mechanic reaches through the axle housing to hold the bolt located on the backside of the wheel to prevent the bolt from rotating while removing or replacing the nuts on the bolts from the frontside of the wheel. This process is labor intensive, costly and can only be performed with a mechanic that has an extremity, which is small enough to fit through the axle housing of the wheel.

The present invention is directed to overcoming one or more of the problems set forth above.

SUMMARY OF THE INVENTION

An aspect of the invention is to provide a drumbar apparatus and method for assisting mechanics in removing and replacing nuts and bolts from a wheel of trailers, trucks, buses and all other devices that utilize Dayton Wheels™ or spoke wheels in such a manner that the necessary assembly and disassembly costs and labor times are reduced with improved assembly and disassembly techniques and excellent performance.

In one aspect of this invention there is provided a drumbar apparatus for allowing one mechanic to position himself/herself on the frontside of a wheel and wherein said mechanic extends said drumbar through the axle housing to hold a bolt with said drumbar on the backside of the wheel to prevent the bolt from rotating while the mechanic removes or replaces the nut of the frontside of the wheel.

In another aspect of this invention there is provided a method in which one mechanic positioned in front of a wheel extends a drumbar through the axle housing and holds the bolt of a wheel located on the backside of the wheel with the drumbar to prevent the bolt from rotating while removing or replacing the nut on the frontside of the wheel.

With respect to the two mechanic process previously described, this invention reduces the number of mechanics needed for removing or replacing the nuts and bolts on a wheel to remove and replace the brake drums, hence, the labor costs are substantially lowered as a result of the drumbar.

With respect to the one mechanic process previously described, the labor time and required skill level of the mechanic for removing and replacing the nuts and bolts to remove and replace the brake drums are reduced, hence, the labor costs are substantially lowered and the required skill level of the mechanic is reduced as a result of the drumbar.

BRIEF DESCRIPTION OF THE DRAWINGS

Reference is now made to the drawings, which illustrate the best known mode of carrying out the invention and wherein the same reference characters indicate the same or similar parts throughout the views.

DETAILED DESCRIPTION

Figure 5:
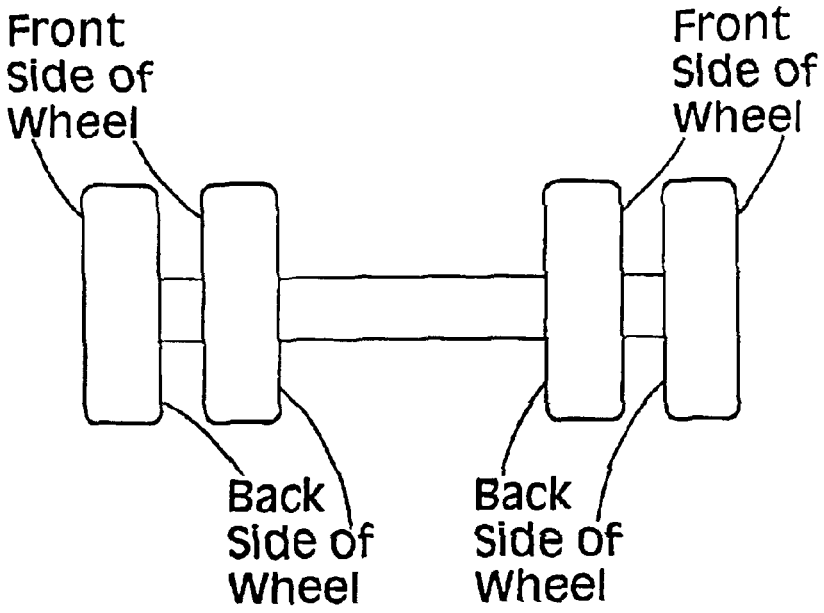
FIG. 5 is a perspective illustration of a frontside and backside of a wheel.
Figure 6:
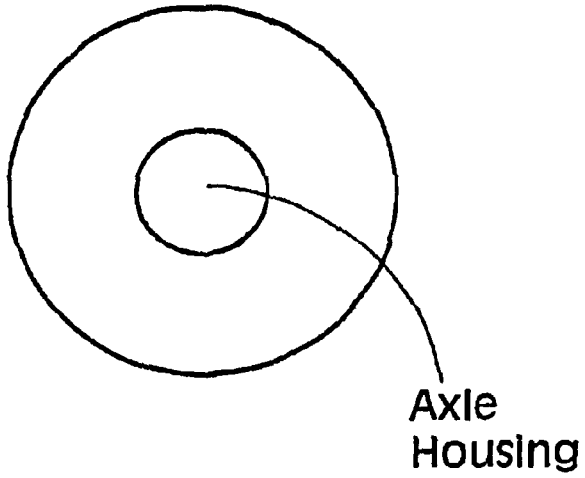
FIG. 6 is a perspective illustration of an axle housing of a wheel from the frontside of a wheel.

Trailers, trucks, buses and all other devices that utilize Dayton Wheels™ or spoke wheels have brake drums (not shown) which are secured to the wheel with, inter alia, nuts 23 and bolts 21. The nuts 23 and bolts 21 are removable from the wheel assembly. This is different than the arrangements in automobiles, pick-up trucks and single-wheeled trucks. For trailers, trucks, buses and all other devices that utilize Dayton Wheels™ or spoke wheels, the bolt 21 is held in place by the nut 23 and wherein said bolt 21 has a bolt head 22. The bolt 21 extends from the backside of the wheel to the frontside of the wheel. When assembled to the wheel, the bolt head 22 is located on the backside of the wheel which is difficult to access and the nut 23 which is threaded onto the bolt is located on the frontside of the wheel which is more readily accessible. FIG. 5 illustrates the frontside and backside of the wheel. For disassembly of the bolts 21 and nuts 23 from the wheel, the bolt 21 is held to prevent the bolt 21 from rotating while the nut 23 is rotated and removed from the bolt 21 to remove and replace the brake drums. For re-assembly of the bolt 21 and nut 23 to the wheel, the bolt 21 is held to prevent the bolt 21 from rotating while the nut 23 is rotated to replace the nut 23 on the bolt 21 whereby the brake drums are secured to the wheel. The invention is a method and drumbar 1 used to assist the mechanic in the disassembly and re-assembly and is explained hereinafter.

Figure 1:
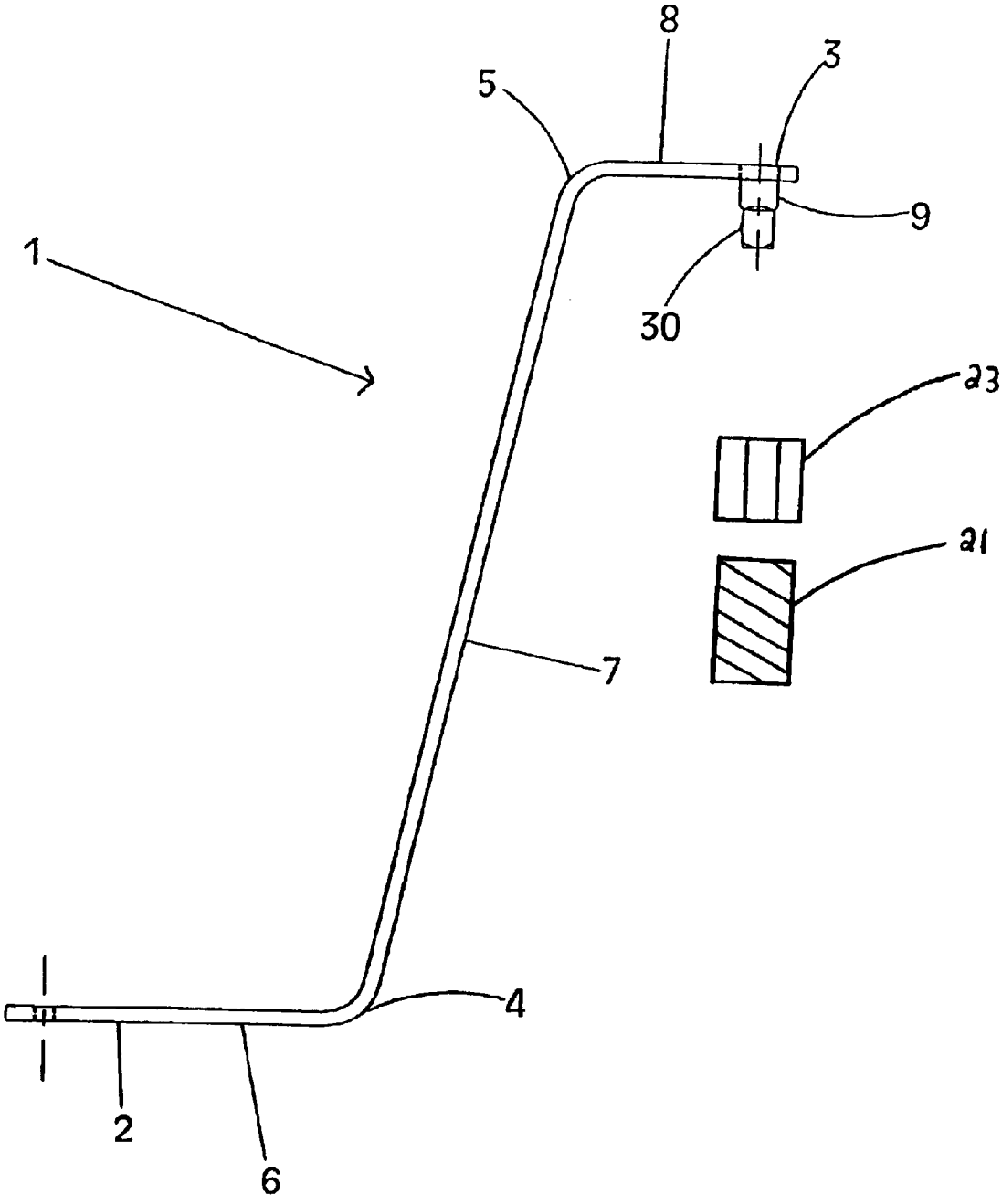
FIG. 1 is a side view of a drumbar.
Figure 2:
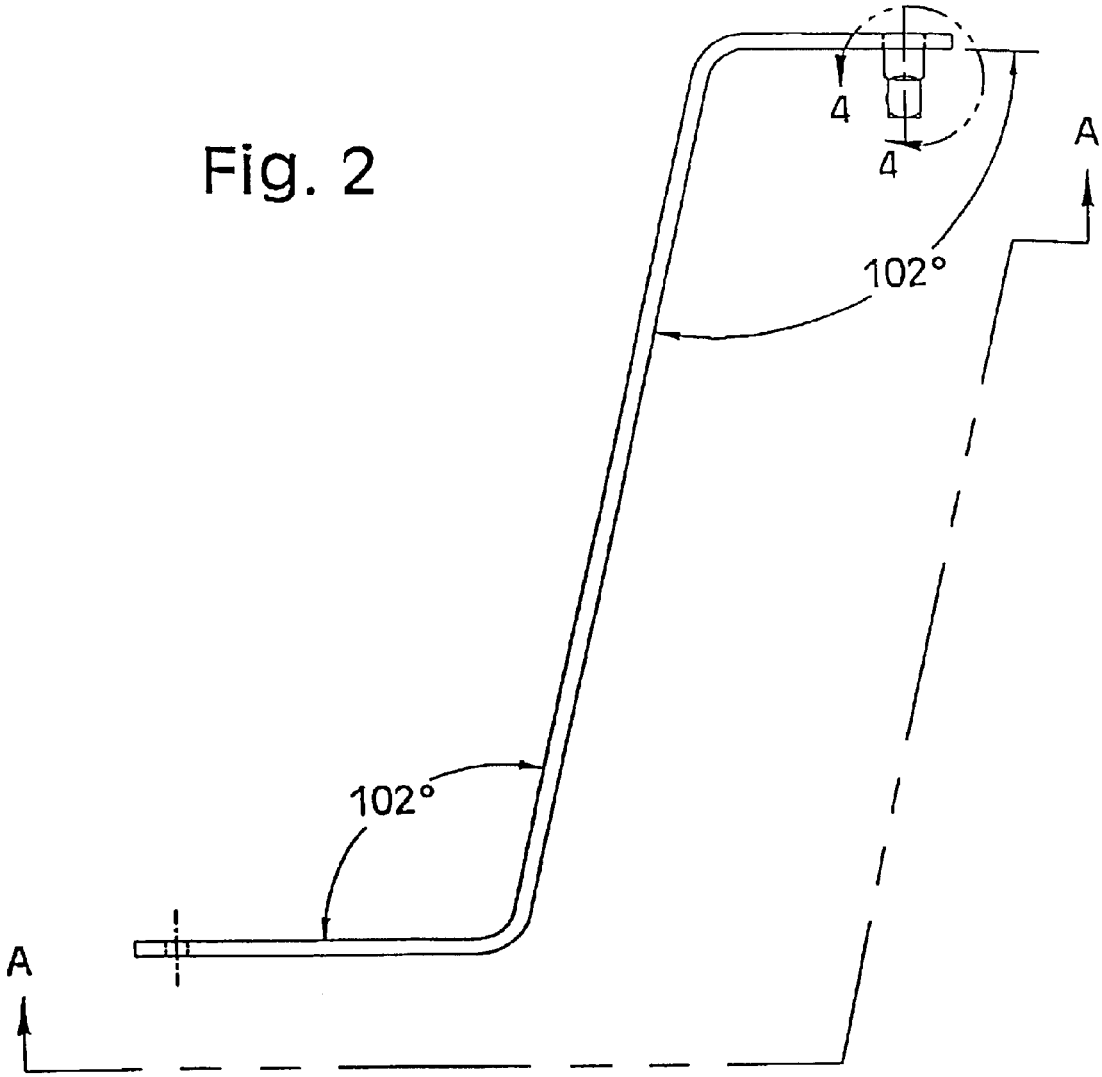
FIG. 2 is a side view of the drumbar with angle dimensions.
Figure 3:
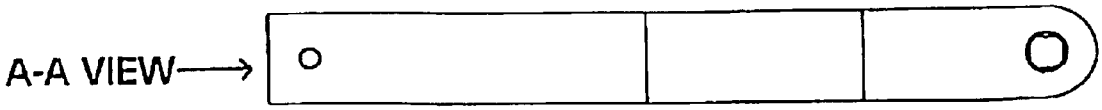
FIG. 3 is a top view of the drumbar.
Figure 4:
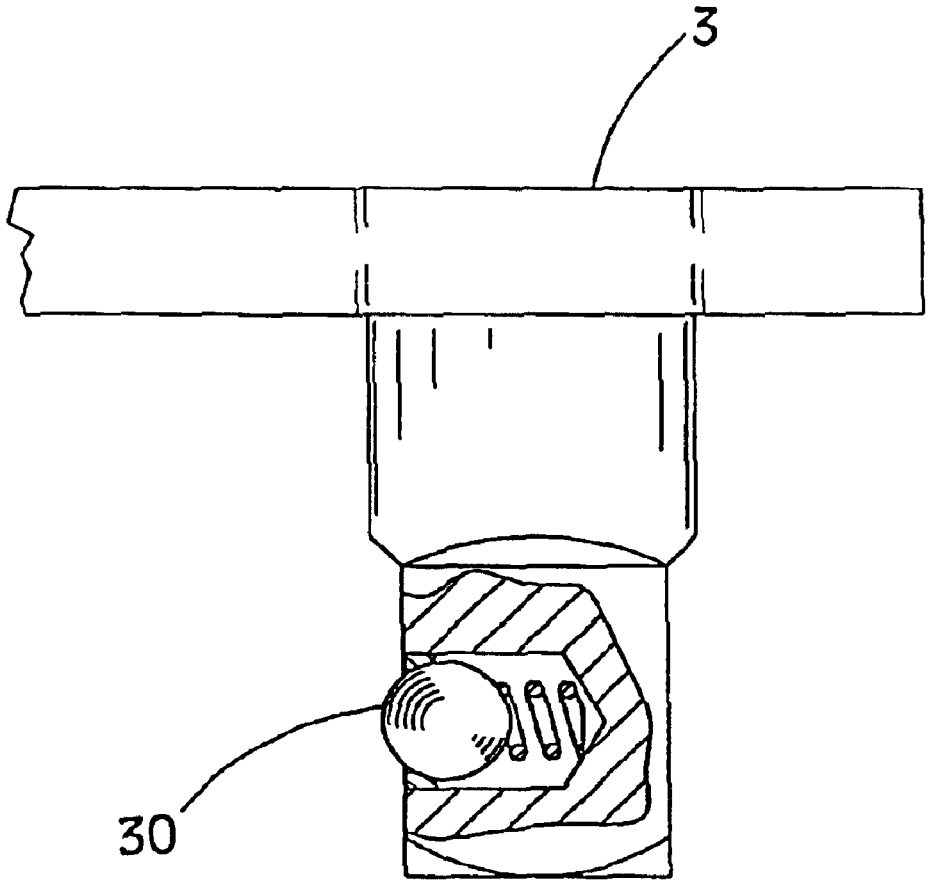
FIG. 4 is an enlarged view of the wrench end shown in FIGS. 1 and 2.

Referring now to the drawings, and initially to FIG. 1, the drumbar 1 is shown with a handle end 2 and wrench end 3. In the preferred embodiment, the drumbar 1 has a first bend 4 and second bend 5; however, it is possible to have only one bend 5 between the handle 2 and wrench end 3. The handle 2 is located on a first end portion 6. After the first bend 4, an intermediate portion 7 connects the first end portion 6 with a second end portion 8. The intermediate portion 7 is not parallel to said first end portion 6. The second bend 5 is located between the intermediate portion 7 and second end portion 8. The intermediate portion is not parallel to said second end portion 8. The second end portion 8 has the wrench end 3 mounted thereon. The wrench end 3 has a drive socket receiver 9 that is substantially perpendicular to said wrench end 3 for receiving different size sockets. The wrench end 3 is sized to mate with a socket (not shown) wherein said socket will accept the bolt head 22. It is obvious to those skilled in the art that the wrench end 3 configuration is dependent upon the sockets, and the socket size will be selected according to the size of the bolt head 22 and no further explanation is needed. However, in the preferred embodiment, the wrench end 3 is hexagonal with a half-inch drive socket receiver 9 and different size sockets can be attached as the case may be. A ball bearing 30 is protruding slightly from the wrench end 3, which is typical with most ratchet socket receivers. The ball bearing 30 is movable and under spring tension.

If a mechanic attempts to remove or replace the nut 23 by rotating the nut 23 without preventing the bolt 21 from rotating, the bolt 21 will rotate along with the nut 23. To prevent this from occurring, the drumbar 1 allows one mechanic to conveniently position himself/herself at the frontside of the wheel wherein the mechanic extends the drumbar 1 through the axle housing and holds the bolt head 22 with the socket mounted on the wrench end 3 of the drumbar 1 and simultaneously removing the nut 23. The drumbar 1 is fitted with the appropriate socket. The socket size is dependent upon the size of the bolt head 22. Once again, there are various socket sizes, and the mechanic need only determine the correct bolt head 22 size to determine the correct socket size. The socket is then mated with the drive socket receiver 9. Once again, the mechanic extends the drumbar 1 through the axle housing and the socket on the drive socket receiver 9 of said drumbar 1 is placed over the bolt head 22, which holds the bolt 21. The mechanic holds the drumbar 1, in one hand, to prevent the bolt 21 from rotating, while at the same time the mechanic rotates the nut 23 using his/her other hand to control a tool (not shown) that removes or replaces said nut 23 from or on the bolt 21. The drumbar 1 allows one mechanic positioned at the frontside of the wheel to remove and replace nuts and bolts on a wheel.

Other objects, features, advantages and applications will be apparent to those skilled in the art. While preferred embodiments of the present invention have been illustrated and described, this has been by way of illustration and the invention should not be limited except as required by the scope of the appended claims.

What we claim is:

1. A drumbar apparatus for use in removal and replacement of brake drums mounted on a spoked wheel of a vehicle; the spoked wheel having a frontside, a backside and an axle housing extending therethrough; said drumbar apparatus comprising:

an elongated intermediate portion for insertion thorugh the axle housing of the spoked wheel and having opposite ends;

a wrench end portion at one end of the intermediate portion and extending at an angle of about 102 degrees therefrom;

an anti-slip handle at the other end of the intermediate portion and extending in the opposite direction from and substantially parallel to the wrench end portion;

a socket mounting member having a spring-urged detent, the socket mounting member being mounted at a distal end of the wrench end portion and extending perpendicular thereto in a direction toward the handle;

a socket on the socket mounting member; and the wrench end and intermediate portion constructed and arranged for insertion through the axle housing of the spoked wheel for engaging the socket with a nut or bolt head on the backside of the spoked wheel so that a user can hold the nut or bolt head while utilizing another wrench at the frontside of the spoked wheel to remove or retighten a bolt to remove and replace a brake drum mounted on the backside of the spoked wheel.

* * * * *